US011795799B2

(12) United States Patent
Wilson

(10) Patent No.: US 11,795,799 B2
(45) Date of Patent: Oct. 24, 2023

(54) COMPOUND ELECTRO-HYDRAULIC FRAC PUMPING SYSTEM

(71) Applicant: Twin Disc, Inc., Racine, WI (US)

(72) Inventor: Edwin E. Wilson, Colleyville, TX (US)

(73) Assignee: Twin Disc, Inc., Racine, WI (US)

( * ) Notice: Subject to any disclaimer, the term of this patent is extended or adjusted under 35 U.S.C. 154(b) by 0 days.

(21) Appl. No.: 17/824,485

(22) Filed: May 25, 2022

(65) Prior Publication Data

US 2022/0381125 A1 Dec. 1, 2022

Related U.S. Application Data

(60) Provisional application No. 63/192,682, filed on May 25, 2021.

(51) Int. Cl.

| | |
|---|---|
| ***E21B 43/26*** | (2006.01) |
| ***F04B 17/03*** | (2006.01) |
| ***F04D 13/12*** | (2006.01) |

(52) U.S. Cl.

CPC ..... *E21B 43/2607* (2020.05); *E21B 43/26* (2013.01); *F04B 17/03* (2013.01); *F04D 13/12* (2013.01)

(58) Field of Classification Search

CPC ..... E21B 43/2607; E21B 43/26; F04B 17/03; F04B 23/06; F04D 13/12

See application file for complete search history.

(56) References Cited

U.S. PATENT DOCUMENTS

| | | | | |
|---|---|---|---|---|
| 2014/0174717 | A1* | 6/2014 | Broussard | E21B 43/2607 166/66.4 |
| 2015/0252661 | A1 | 9/2015 | Glass | |
| 2020/0040878 | A1* | 2/2020 | Morris | E21B 43/26 |
| 2020/0208565 | A1 | 7/2020 | Morris | |
| 2020/0224645 | A1* | 7/2020 | Buckley | F04B 1/0538 |
| 2021/0340973 | A1* | 11/2021 | Nagler | F04B 49/065 |
| 2022/0364451 | A1* | 11/2022 | Sharp | F04B 17/03 |

FOREIGN PATENT DOCUMENTS

| | | | | |
|---|---|---|---|---|
| WO | 2018044307 | | 3/2018 | |
| WO | 2020214934 | | 10/2020 | |
| WO | WO-2020214934 | A1 * | 10/2020 | E21B 43/2607 |

* cited by examiner

*Primary Examiner* — James G Sayre
(74) *Attorney, Agent, or Firm* — Boyle Fredrickson S.C.

(57) ABSTRACT

An electrically driven oilfield pumping system may include a compound electro-hydraulic fracturing (frac) pump system that has a primary electric motor that selectively delivers power to one or more of at least two fracturing (frac) pumps. The primary electric motor may be a constant speed alternative current (AC) motor with a fixed rated speed.

16 Claims, 5 Drawing Sheets

COMPONENT/STATE

| Mode | Sub- Mode | 1st Start APU | 2nd Start APU | 1st Slow APU | 2nd Slow APU | Prim. Elec. Motor | 1st Frac Pump | 2nd Frac Pump |
|---|---|---|---|---|---|---|---|---|
| Starting | Single (1st) | A | I | I | I | I | I | I |
| | Single (2nd) | I | A | I | I | I | I | I |
| | Compound | A | A | I | I | I | I | I |
| Slow Speed Frac | Single (1st) | I | I | A | I | I | A | I |
| | Single (2nd) | I | I | I | A | I | I | A |
| | Compound | I | I | A | A | I | A | A |
| Normal Speed Frac | Single (1st) | I | I | I | I | A | A | I |
| | Single (2nd) | I | I | I | I | A | I | A |
| | Compound | I | I | I | I | A | A | A |

A=Active

I-Inactive

FIG. 4

COMPOUND ELECTRO-HYDRAULIC FRAC PUMPING SYSTEM

CROSS-REFERENCE TO RELATED APPLICATION

This application claims priority to U.S. Provisional Patent Application No. 63/192,682, filed on May 25, 2021, and entitled "Compound Electro-Hydraulic Frac Pumping System", the entirety of which is expressly incorporated by reference herein.

BACKGROUND OF THE INVENTION

Field of the Invention

The preferred embodiments relate generally to the field of hydrocarbon recovery from the earth and, more specifically, to oilfield pressure pumping systems for fracturing underground formations to enhance recovery of hydrocarbons.

Discussion of the Related Art

Hydraulically fracturing subterranean formations with oilfield pressure pumping systems to enhance flow in oil and gas wells is known. Hydraulic fracturing increases well productivity by increasing the porosity of, and thus flow rate through, production zones that feed boreholes of the wells that remove underground resources like oil and gas.

Oilfield pressure pumping systems include heavy-duty industrial-type components to create the extreme hydraulic pressures, for example, 10,000 psi or more, which are needed to fracture (frac) the subterranean geological formations. Positive displacement, high pressure, and/or plunger pumps are used as fracturing (fracking or frac) pumps to generate the extreme hydraulic pressures that are capable of fracturing subterranean geological formations.

Flow and pressure of frac fluids from frac pumps must be closely regulated at the various fracturing stages in order to adequately control the fracturing process. Accordingly, prime movers that deliver power to the frac pumps are variable speed devices, since driving the frac pumps at variable speeds at least partially provides the flow and pressure control.

Typically, the prime movers are high horsepower stationary diesel engines that deliver power to the frac pumps through multi-speed gearboxes or transmissions. High horsepower stationary diesel engines are expensive and require maintenance and operational attention, such as refueling.

Other attempts have been made to use variable speed electric motors to power frac pumps. Variable speed electric motors can vary flow and pressure of the frac pumps through speed-varying motor controls, which facilitates control of the fracturing operation. Variable speed electric motors either directly drive the frac pumps at the motors' variable speeds or with an intervening single-speed gearbox or transmission. Such variable speed electric motors include shunt wound, variable speed, DC (direct current) traction motors and variable speed, for example, variable frequency, AC (alternating current) electric motors. Although variable speed electric motors can require less operational attention than high horsepower stationary diesel engines, they are expensive and require sophisticated motor controls.

Constant speed AC motors are more straightforward than variable speed electric motors but have not been used to deliver power to frac pumps. That is because the fixed speed(s) of constant speed AC motors do not provide the desired amount of flow and pressure control of the frac pumps to allow operators to suitably control the fracturing operation. Typical multi-speed gearboxes are unable to resolve this problem with constant speed AC motors because they are unable to shift under full load and have range ratios that are ill-suited to provide a sufficient variety of output shaft speeds or corresponding frac pump flow and pressure control.

Furthermore, constant speed AC motors of high-enough horsepower ratings to power frac pumps are difficult to start because they require extremely high starting currents as in-rush (locked rotor) currents to begin their rotations.

Additionally, like pressure pumping systems that use internal combustion engines, pressure pumping systems that are electrically driven require substantial amounts of jobsite space, typically implemented as multiple trailer-mounted frac pump systems that collectively provide the pressurized frac fluid for delivery into a well. Each electric motor that drives a frac pump requires large conductors or electrical cables to transmit electrical power from an electrical power system to the motor. These large electrical cables are heavy and expensive. Furthermore, cable management or routing the large electrical cables in a tidy manner at an oilfield site can be challenging.

Therefore, what is needed is a prime mover for high pressure pumping applications, like powering frac pumps, employing a constant speed AC motor, but without the above-noted drawbacks primarily directed to flow and pressure control.

SUMMARY AND OBJECTS OF THE INVENTION

The preferred embodiments overcome the above-noted drawbacks by providing an electrically driven oilfield pumping system with a compound electro-hydraulic fracturing (frac) pump system that has a primary electric motor that selectively delivers power to one or more of at least two fracturing (frac) pumps. The compound electro-hydraulic frac pump system may incorporate a constant speed AC motor and a pair of frac pumps that can individually or together selectively receive power from the AC motor.

The compound electro-hydraulic frac pump system may further include a transmission system with a pair of transmissions that selectively deliver power from the AC motor to a pair of frac pumps. The AC motor may have a pair of outputs that deliver power to the pair of transmissions.

The system may include multiple APUs (auxiliary power units) that can, for example, provide power into or through various system components while the AC motor is de-energized. The multiple APUs may include a pair of start-APUs mounted to the pair of transmissions. Each of the start-APUs may be individually used to provide a torque that pre-rotates a main shaft of the de-energized AC motor to rotate it to its rated speed before the AC motor is energized during a single-APU starting mode. Both start-APUs may be simultaneously used to provide a torque that pre-rotates the AC motor's main shaft to rotate it to its rated speed before the AC motor is energized during a compound-APU starting mode.

The multiple APUs may include a pair of slow-frac-APUs mounted to the pair of transmissions. During a single-APU slow frac mode, one of the slow-frac-APUs may be individually used to provide a torque that drives a corresponding frac pump at a de-rated speed or slower than the frac pump can be driven by the AC motor during a normal speed frac mode. Both start-APUs may be simultaneously used to provide a torque that simultaneously drives both frac pumps during a compound-APU slow frac mode.

These, and other aspects and objects of the present invention, will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical embodiments of the present invention, will become more readily apparent by referring to the exemplary and, therefore, non-limiting, embodiments illustrated in the drawings accompanying and forming a part of this specification, wherein like reference numerals designate the same elements in the several views, and in which:

FIG. 4 is a chart showing operational states of various components in different modes and sub-modes of a compound electro-hydraulic frac pumping system, according to a further preferred embodiment.

Figure 1:
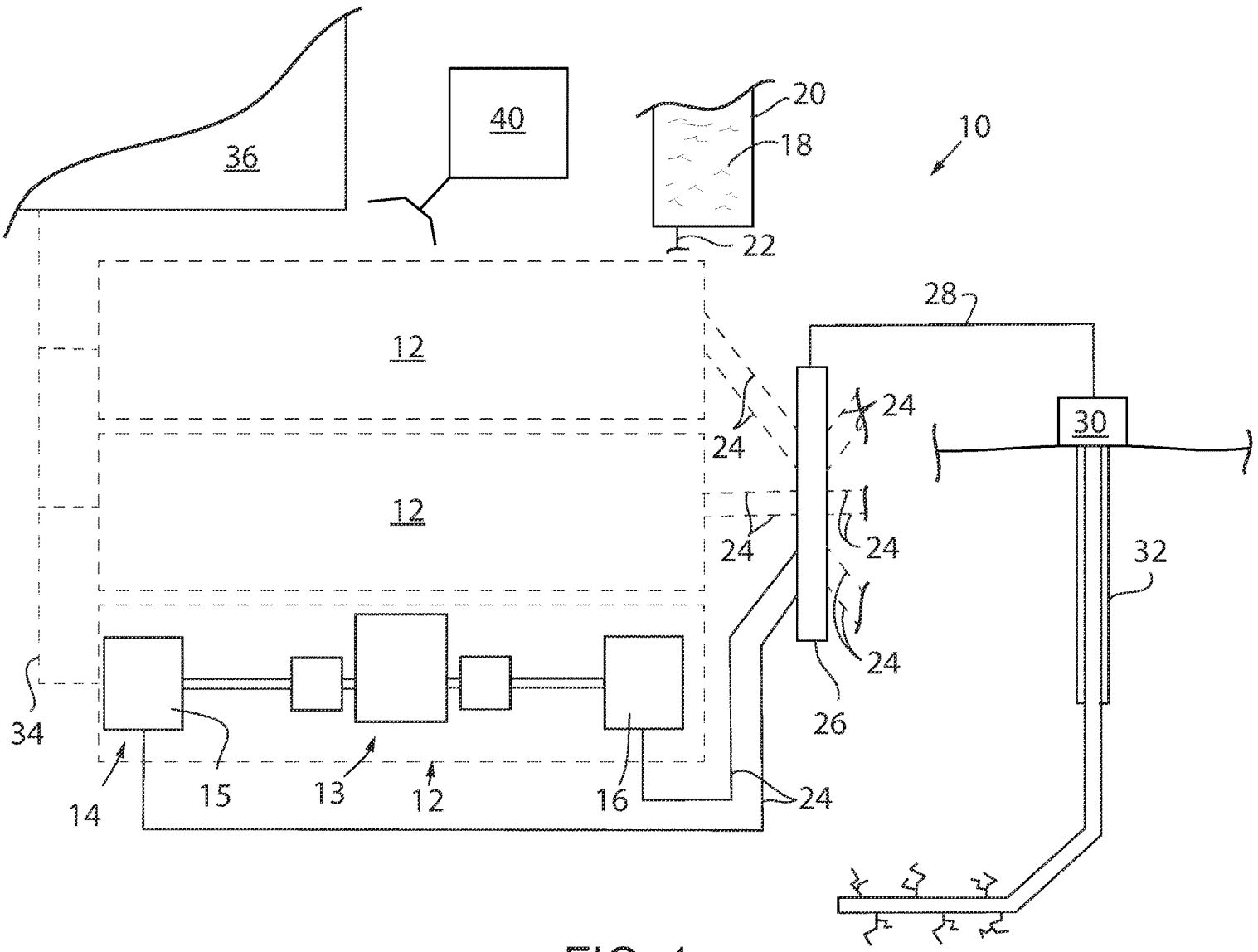
FIG. 1 is a schematic illustration of an oilfield pressure pumping system incorporating compound electro-hydraulic frac pumping systems, according to a preferred embodiment.

In describing preferred embodiments of the invention, which are illustrated in the drawings, specific terminology will be resorted to for the sake of clarity. However, it is not intended that the invention be limited to the specific terms so selected, and it is to be understood that each specific term includes all technical equivalents, which operate in a similar manner to accomplish a similar purpose. For example, the words "connected", "attached", "coupled", or terms similar thereto are often used. They are not limited to direct connection but include connection through other elements where such connection is recognized as being equivalent by those skilled in the art.

DETAILED DESCRIPTION OF PREFERRED EMBODIMENTS

Referring to FIG. 1, one embodiment of the invention is an electro-hydraulic high-pressure pumping system, shown as an electrically driven oilfield pumping system or pumping system 10. The pumping system 10 is shown here implemented as a compound electro-hydraulic frac pumping system 12, which includes an electro-hydraulic drive system 13 that delivers power to a fracturing (frac) pump system 14 that includes at least a pair of frac pumps 15, 16. Each frac pump 15, 16 can be a positive displacement, high-pressure, plunger pump or other suitable pump that can deliver high flow rates and produce high pressures, for example, 10,000 psi or more. This oilfield site is shown with multiple compound electro-hydraulic frac pumping systems 12, each of which has two frac pumps 15, 16 in their frac pump systems 14, that operate together for a subterranean geological formation fracturing or fracking operation to stimulate well production.

Within each compound electro-hydraulic frac pumping system 12, the respective frac pumps 15, 16 can be activated or brought online and implemented separately or together, depending on the particular pumping needs for a given fracking operation or operational stage, as intra-system activation states. Each of the compound electro-hydraulic frac pumping systems 12 is typically implemented as a singularly-packaged unit, for example, mounted on a trailer that can be towed by a semi-tractor or other tow vehicle. Each frac pump 15, 16 receives fracturing fluid or frac fluid 18 that is stored in a frac fluid storage system 20 and delivers the frac fluid 18 to the frac pumps 15, 16 through frac fluid delivery lines 22. Pressurized frac fluid 18 is delivered from the frac pumps 15, 16, through manifold delivery lines 24, to manifold 26 that delivers the pressurized frac fluid 18 through a manifold outlet line 28 to a wellhead 30. At the wellhead 30, the frac fluid 18 is directed to flow through a borehole that extends through a well casing 32 for fracturing the subterranean formation.

Still referring to FIG. 1, compound electro-hydraulic frac pumping system 12 selectively receives electrical power through conductors 34 from electrical power system 36. Electrical power system 36 includes a generator and prime mover such as a combustion engine which may be a gas turbine engine. A frac site control system represented as control system 40 includes a computer that executes various stored programs while receiving inputs from and sending commands to the compound electro-hydraulic frac pumping system 12 for controlling, for example, energizing and de-energizing various system components as well as bringing the compound electro-hydraulic frac pumping system 12 online for fracking the subterranean formations by controlling the various electronic, electromechanical, and hydraulic systems and/or other components of each compound electro-hydraulic frac pumping system 12. Control system 40 may include the TDEC-501 electronic control system available from Twin Disc®, Inc. for controlling the compound electro-hydraulic frac pumping system(s) 12. By controlling the compound electro-hydraulic frac pumping system 12, control system 40 can change and/or control operating modes by varying operational states of various corresponding components and/or subsystems within system 10.

Figure 2:
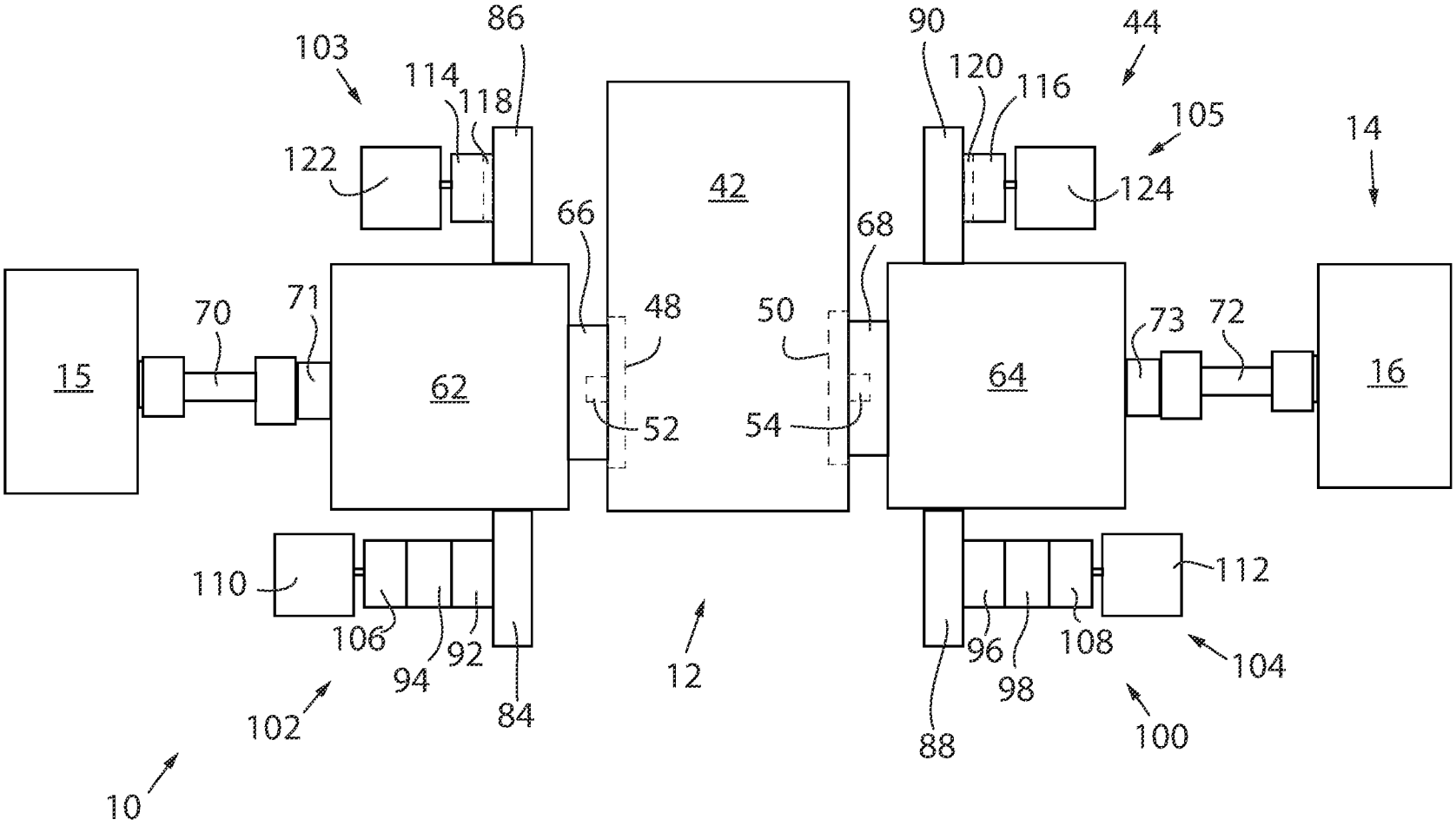
FIG. 2 is a schematic illustration of a compound electro-hydraulic frac pumping system, according to another preferred embodiment.

Referring now to FIG. 2, compound electro-hydraulic frac pumping system 12 includes a primary electric motor 42, and a transmission system 44. Primary electric motor 42 is typically implemented as a high-powered constant speed AC motor, for example, about 6,000 HP (horsepower) or having an equivalent torque rating of about a 6,000 HP diesel engine. Primary electric motor 42 may operate at a relatively slow fixed rotational speed, such as a fixed rated speed of about 1,800 RPM (rotations per minute). A pair of outputs or first output 48 and second output 50 are defined at opposite ends of primary electric motor 42. Outputs 48, 50 are typically implemented as a pair of output shafts or first output shaft 52 and second output shaft 54 that are coaxially aligned with each other and extend from opposite ends of the primary electric motor 42.

Still referring to FIG. 2, primary electric motor 42 is typically implemented in a sandwiched configuration with respect to transmission system 44. Transmission system 44 typically includes a pair of transmissions, shown as first transmission 62 and second transmission 64, that have input shafts (not labeled) which respectively receive power from the primary electric motor's output shafts 52, 54. Output shafts 52, 54 may be defined by opposite ends of a single or common axially extending main shaft of primary electric motor 42, which rotates in unison with its rotor or armature. Transmissions 62, 64 are shown here in a close couple mounting configuration with respect to primary electric motor 42, which may be implemented as flexible couplings 66, 68 at the transmission inputs without intervening torque converters or clutches. Regardless of the particular connecting components between primary electric motor 42 and transmissions 62, 64, each transmission 62, 64 has a heavy-duty industrial gearbox or transmission. Typically, each transmission 62, 64 is a multi-speed transmission having multiple ranges that provide multiple substantially evenly spaced drive ratios to facilitate close regulation of rotational speed of the transmission output shaft and, correspondingly, operational speed of components within frac pump system 14 and output flow and pressure from frac pump system 14. A suitable transmission includes, for example, a model TA90-7600, available from Twin Disc®, Inc., which is capable of changing ranges while the frac pump 15, 16 is fully loaded. Driveshafts 70, 72 transmit torque from transmissions 62, 64 to frac pumps 15, 16 of the frac pump system 14. Clutches 71, 73 are shown between the transmission 62, 64 outputs and the driveshafts 70, 72 and are configured to selectively disconnect power transfer between the respective transmission 62, 64 and frac pump 15, 16, shown upstream of the driveshafts 70, 72. It is understood that clutches 71, 73 may be arranged between other adjacent power-transmitting components in order to, for example, prevent or allow power transfer from primary electric motor 42 to either or both of frac pumps 15, 16. In one example, clutches 71, 73 provided between the primary motor output shafts 52, 54 and transmission 62, 64 inputs, which may be done instead of, or in addition to, the flexible couplings 66, 68.

Still referring to FIG. 2, transmissions 62, 64 are shown with PTO towers or sections with respective pairs of pump pads 84, 86 and 88, 90 for mounting and mechanically delivering power to or receiving power from various components, for example, hydraulic components. Each of the lower illustrated pump pads 84, 88 is shown supporting a respective pair of transmission pumps or charging and lube pumps 92, 94 and 96, 98 which may be configured to, for example, supply pressurized oil for transmission lubrication and controlling hydraulically actuated components within the transmission. Although transmissions 62, 64 and their various components and/or accessories may be identical, typically, one of the pair of charging and lube pumps 92, 94 and 96, 98 is internally modified. The internal modification of the charging and/or lube pump(s) 92, 94 or 96, 98 may be a mirror image reconfiguration compared to the non-modified configuration, to allow its/their rotation in an opposite direction of the non-modified configuration. This allows for driving the charging and/or lube pump(s) 92, 94 or 96, 98 in a common direction even though transmissions 62, 64 receive power through rotational inputs in opposite directions because of the opposed relationship of transmissions 62, 64 with respect to the (single) primary electric motor 42.

Still referring to FIG. 2, an auxiliary power unit (APU) system 100 selectively delivers power through one or both transmission(s) 62, 64. APU system 100 is shown with electro-hydraulic-start auxiliary power units (APUs) or start-APUs 102, 104 at transmissions 62, 64 and electro-hydraulic-slow-frac auxiliary power units (APUs) or slow-frac-APUs 103, 105 at transmissions 62, 64. Start-APUs 102, 104 include hydraulic starting motors 106, 108, each of which may be a high speed, low torque, hydraulic motor. Hydraulic starting motors 106, 108 are shown respectively mounted to the charging and/or lube pump(s) 92, 94 or 96, 98 and therefore transmissions 62, 64 by way of pump pads 84, 88. Within the start-APUs 102, 104, electric motors are provided as APU electric starting motors 110, 112 that selectively deliver torque to hydraulic starting motors 106, 108. Each of the APU electric starting motors 110, 112 may be a variable speed AC motor that is substantially smaller than primary electric motor 42, with APU electric starting motors 110, 112 rated at, for example, about 50 HP. Energizing APU electric starting motor 110 activates hydraulic starting motor 106 and energizing APU electric starting motor 112 activates hydraulic starting motor 108, which rotates various gear train or other components of transmissions 62, 64 and correspondingly rotates the shaft(s) 52, 54 of primary electric motor 42 when the primary electric motor 42 is de-energized.

Still referring to FIG. 2, the start-APUs 102, 104 can be operated separately or together to rotate the primary motor shaft(s) 52, 54 during a primary electric motor starting mode. When operated separately to individually rotate the primary motor shaft(s) 52, 54, the start-APUs 102, 104 may be used alternatively during subsequent primary motor shaft(s) rotations in order to reduce instances of usage of each. Otherwise, start-APUs 102, 104 may be used simultaneously to reduce the load burden on each while rotating the primary motor shaft(s) 52, 54. Regardless of the particular control strategy for implementing one or both of the start-APUs 102, 104, primary electric motor's shaft(s) 52, 54 is rotated by at least one of the start-APUs 102, 104 to bring it sufficiently close to its rated fixed speed or synchronous speed before the primary electric motor 42 is energized during a starting mode of system 10. Hydraulic starting motor(s) 106, 108 can correspondingly rotate at about 1,800 RPM or at an appropriate speed that can rotate the primary electric motor's shaft(s) 52, 54 at 1,800 RPM or other speed, depending on the particular rated or synchronous speed of primary electric motor 42. Rotating the primary electric motor 42 with hydraulic starting motor(s) 106, 108 to achieve the synchronous speed of primary electric motor 42 allows connection to the electrical power source DoL (Direct on Line) while avoiding the motor's high in-rush (locked rotor) current that would otherwise be required to start the primary electric motor 42. The primary electric motor 42 is therefore able to be started at essentially its normal running current, when pre-driven to its synchronous speed by hydraulic starting motor(s) 106, 108.

Still referring to FIG. 2, slow-frac-APUs 103, 105 include slow frac hydraulic motors 114, 116, each of which may be configured to, for example, supply slow speed or low flow operation of the respective frac pump 15, 16. Slow frac hydraulic motors 114, 116 may be low speed, high torque, hydraulic motors that are mounted to the pump pads 86, 90. The rotational speed(s) of slow frac hydraulic motors 114, 116 may be a fraction of the rotational speed of hydraulic starting motors 106, 108. Clutches 118, 120 are shown arranged between the slow frac hydraulic motors 114, 116 and pump pads 86, 90 and are configured to disconnect power transfer between the slow frac hydraulic motors 114, 116 and their respective transmissions 62, 64. Each clutch 118, 120 may be an overrunning clutch or an actuatable or other clutch to passively or actively connect or disconnect power flow between the slow frac hydraulic motor 114, 116 and its respective transmission 62, 64 to correspond to different operational states of the fracking system. It is understood that instead of or in addition to implementing clutches 118, 120, when the slow frac hydraulic motor(s) 114, 116 is not being implemented, it can be locked against activation, which may include binding or holding the pistons in the motor(s) fixed, depending on its configuration.

Electric motors, implemented as APU slow frac electric motors 122, 124 of slow-frac-APUs 103, 105, selectively deliver torque to slow frac hydraulic motors 114, 116. Like electric motors 110, 112, each APU slow frac electric motor 122, 124 may be a variable speed AC motor that is substantially smaller than primary electric motor 42, with APU slow frac electric motors 122, 124 rated at, for example, about 50 HP. Energizing APU slow frac electric motor 122 activates slow frac hydraulic motor 114 and energizing APU slow frac electric motor 124 activates slow frac hydraulic motor 116. When activated, slow frac hydraulic motors 114, 116 rotate various gear train or other components of their respective transmissions 62, 64. The activated slow frac hydraulic motor 114 may correspondingly rotate driveshaft 70 through transmission 62 and the activated slow frac hydraulic motor 116 may correspondingly rotate driveshaft 72 through transmission 64 when the primary electric motor 42 is de-energized. In either situation, the activation of slow frac hydraulic motor 114 or the activation of slow frac hydraulic motor 116, the hydraulic motor may rotate the output shaft(s) 52, 54 through the mechanical coupling of the output shaft(s) 52, 54 with the transmissions 62, 64. In this way, either one (or both, simultaneously) of the slow frac hydraulic motors 114, 116 can be activated to rotate primary electric motor's shaft(s) at slow and precisely controlled speeds to deliver torque through the transmission(s) 62, 64 and correspondingly precisely control the frac pump(s) 16 to provide high-pressure low speed fracking. The rotational speed of slow frac hydraulic motor(s) 114, 116 is typically between about 800 RPM to 1,100 RPM or at an appropriate speed that can rotate the primary electric motor 42 shaft at between about 800 RPM to 1,000 RPM or other speed, depending on the particular speed required to produce the desired flow rate of frac pump 15, 16 for high pressure low speed fracking. Regardless, the precise slow speed control of slow frac hydraulic motor 60 may be achieved using a closed-loop controller (e.g., proportional integral derivative (PID) controller) within the control system 40 (FIG. 1) that controls rotational speed of the APU slow frac electric motors 122, 124 that power the slow frac hydraulic motors 114, 116.

Figure 3:
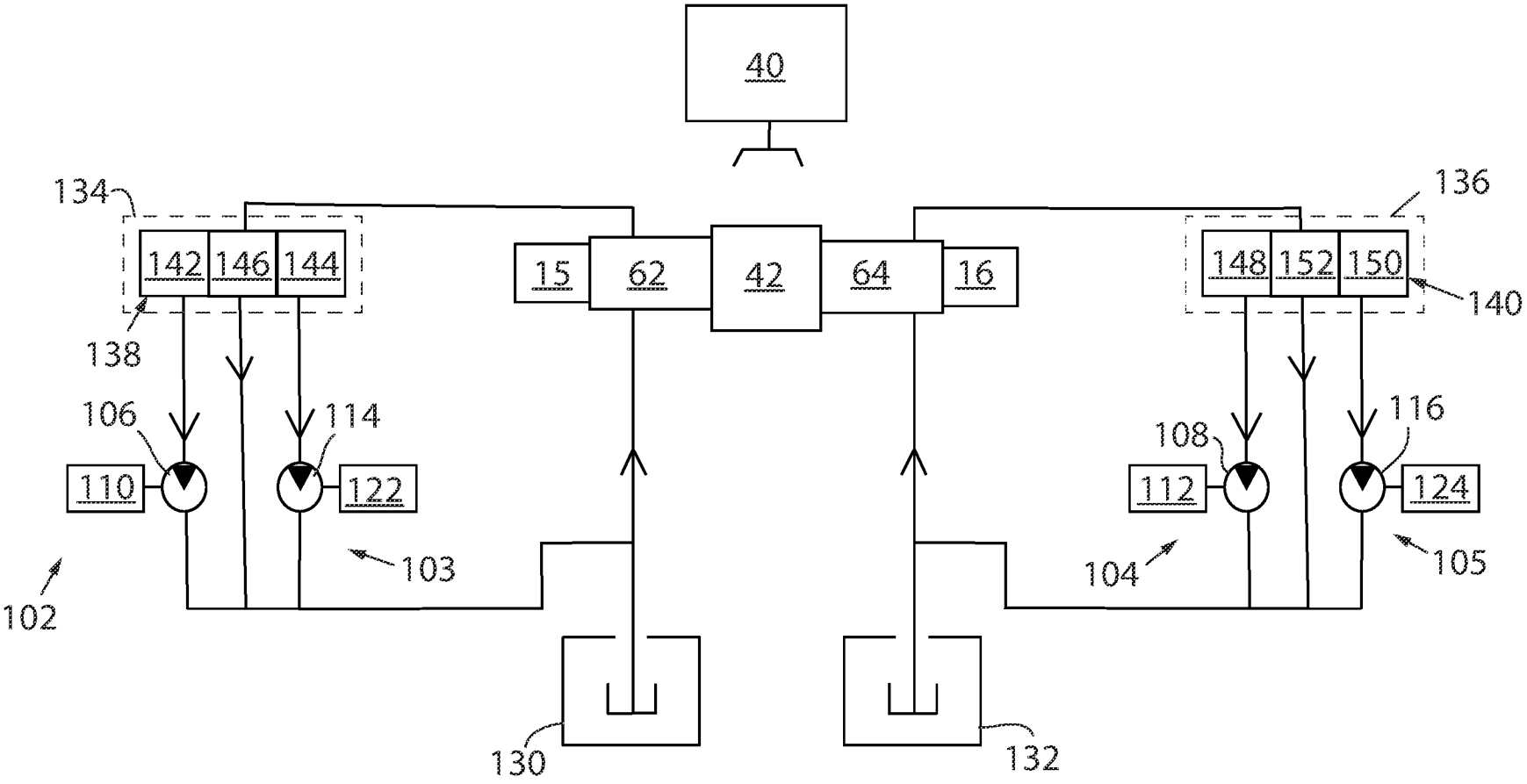
FIG. 3 is a schematic illustration of compound electro-hydraulic frac pumping system, according to a further preferred embodiment.

Referring now to FIG. 3, an exemplary simplified hydraulic schematic layout is shown. At each transmission 62, 64, hydraulic components of the system 10 share a common tank or sump, shown here as reservoir 130 within transmission 62 and reservoir 132 within transmission 64. Hydraulic power packs 134, 136 control flow of hydraulic fluid through various components within transmissions 62, 64. Each of the mode selector valves 138, 140 of hydraulic power packs 134, 136 provides three discrete flow paths of hydraulic fluid out of the respective hydraulic power pack 134, 136. The mode selector valves 138, 140 may be, for example, solenoid actuated spool valves that provide the three discrete positions, represented as positions 142, 144, 146 and 148, 150, 152, to selectively allow flow out of three corresponding outlets and provide three corresponding flow paths out of the hydraulic power packs 134, 136. Actuating the mode selector valves 138, 140 allows for selectively activating and permitting hydraulic fluid flow through the hydraulic starting motor(s) 106, 108, slow frac hydraulic motor(s) 114, 116, or none of them.

Still referring to FIG. 3, a starting mode of system 10 can be achieved in different ways by controlling the start-APUs 102, 104 to force a pre-rotation of the de-energized primary electric motor 42, bring it to approximately its rated speed before its energization. The different ways include a single-APU starting mode in which only one of the start-APUs 102, 104 pre-rotates the de-energized primary electric motor 42 during the starting mode and a compound-APU starting mode in which both of the start-APUs 102, 104 pre-rotate the de-energized primary electric motor 42 during the starting mode. As a first example of a single-APU starting mode, when start-APU 102 is utilized as the pre-rotation APU, mode selector valve 138 is at a first position shown as position 142, which directs hydraulic fluid to hydraulic starting motor 106. This rotates hydraulic starting motor 106, which delivers torque to rotate the output shaft 52 of the de-energized primary electric motor 42 to achieve the motor's synchronous speed in preparation for its energization by connecting to the electrical power source DoL. In another example of a single-APU starting mode, when start-APU 104 is utilized as the pre-rotation APU, mode selector valve 140, is in its first position 148 to rotate hydraulic starting motor 108. Hydraulic starting motor 108 delivers torque to rotate the output shaft 54 of the de-energized primary electric motor 43 to achieve the motor's synchronous speed in preparation of its energization. When in the compound-APU starting mode, both start-APUs 102, 104 share the starting load of pre-rotating the de-energized primary electric motor 42, with both mode selector valves 138, 140 in their first positions 142, 148. This directs hydraulic fluid to and activates both hydraulic staring motors 106, 108 to simultaneously rotate the output shafts 52, 54 of the de-energized primary electric motor 42.

Still referring to FIG. 3, a slow speed frac mode of system 10 can be achieved in different ways by controlling the slow-frac-APUs 103, 105 to serve as a prime mover(s) instead of primary electric motor 42 to deliver frac fluid at a high-pressure but slow speed into the subterranean formation. The different ways include a single-APU slow speed frac mode in which only one of the slow-frac-APUs 103, 105 drives a frac pump 15, 16 and a compound-APU slow speed frac mode in which both of the slow-frac-APUs 103, 105 drive frac pumps 15, 16. Typically, during any of the slow speed frac modes, the slow-frac APU(s) 103, 105 drives its respective frac pump 15, 16 at an underdrive speed, which is slower that the frac pump 15, 16 can be driven by the primary electric motor 42. Also in any of the slow speed frac modes, the slow-frac-APU(s) 103, 105 used as the frac pump-powering prime mover(s) typically transmits power through the de-energized primary electric motor's shaft(s) as a passively driven torque-transmitting component(s) that transmits torque back into the respective transmission(s) 62, 64 to drive the corresponding frac pump(s) 15, 16.

Still referring to FIG. 3, as a first example of a single-APU slow speed frac mode, when slow-frac APU 103 is utilized as the slow frac APU, mode selector valve 138 is at a second position shown as position 144 and hydraulic fluid directed to slow frac hydraulic motor 114. This rotates an output shaft of slow frac hydraulic motor 114 that delivers torque through the primary motor's output shaft 52 (FIG. 2) to rotate the primary motor's main shaft and deliver torque through transmission 62 and to the frac pump 15 to achieve high-pressure, slow speed, fracking in the slow frac mode of system 10. In another example of a single-APU slow speed frac mode, when slow-frac APU 105 is utilized as the slow frac APU, mode selector valve 140 is in its second position 150 to direct hydraulic fluid to slow frac hydraulic motor 116. This rotates an output shaft of slow frac hydraulic motor 116 that delivers torque through the primary motor's output shaft 54 (FIG. 2) to rotate the primary motor's main shaft and deliver torque through transmission 64 and to the frac pump 16 to achieve high-pressure, slow speed, fracking in the slow frac mode of system 10. When in the compound-APU slow speed frac mode, both slow-frac-APUs 103, 105 share the frac pump driving task(s), with both mode selector valves 138, 140 in their second positions 144, 150. This directs hydraulic fluid to and activates both of the slow frac hydraulic motors 114, 116, to deliver torque through the output shafts 52, 54 of the de-energized primary electric motor 42 and various transmission components to drive the frac pumps 15, 16 to achieve high-pressure, slow speed, fracking in the slow frac mode of system 10.

Still referring to FIG. 3, at each of the mode selector valves 138, 140, it is at a third position shown as neutral position 146, 152, hydraulic fluid that would otherwise be directed to hydraulic starting motor 106, 108 or slow frac hydraulic motor 114, 116 is instead directed to tank or reservoir 130, 132 of the respective transmission 62, 64. Each selector valve 138, 140 is actuated to or held in this neutral or third position 146, 152 when, for example, for the particular associated start-APU 102, 104 or slow-frac APU 103, 105 is the inactive APU during a single-APU mode in which only one is being used. Both selector valves 138, 140 are actuated or held in the neutral or third position 146, 152 when, for example, primary electric motor 42 is energized and driving frac pump(s) 15, 16 through transmission(s) 62, 64 and shaft(s) 70, 72, which provides default or normal fracking operation as a default frac mode or normal speed frac mode of system 10. During normal speed frac mode, positioning selector valves 138, 140 to their neutral or third positions 146, 152 avoids any non-desired pumping through hydraulic starting motor(s) 92, 108 or slow frac hydraulic motor(s) 114, 116 by preventing flow to or through them. Such inadvertent passive pumping can be yet further prevented with respect to slow frac hydraulic motor(s) 114, 116 by, for example, clutch(es) 118, 120 (FIG. 2) that either allows the rotating mechanism(s) of pump pad(s) 86, 90 to overrun the slow frac hydraulic motor(s) 118, 120 or disengage a selective driving engagement between the pump pad(s) 86, 90 and the slow frac hydraulic motor(s) 114, 116.

Still referring to FIG. 3, normal speed frac mode of system 10 can be achieved by controlling, for example, the clutches 71, 73 (FIG. 2) and/or transmissions 62, 64, to selectively deliver power to and deliver frac fluid 18 (FIG. 1) from the frac pumps 15, 16. The different ways include a normal-speed single-pump frac mode in which only one of the frac pumps 15, 16 is activated and a normal-speed compound pump frac mode in which both of the frac pumps 15, 16 are activated. Referring again to FIG. 2, as a first example of a normal speed single pump frac mode, in which frac pump 15 is the active frac pump, clutch 71 is engaged to establish a power flow from primary electric motor output shaft 52 and transmission 62 through shaft 70 to drive frac pump 15 and clutch 73 is disengaged to disconnect power transmission from primary electric motor 42 to frac pump 16. As a second example of a normal speed single pump frac mode, in which frac pump 16 is the active frac pump, clutch 73 is engaged to establish a power flow from primary electric motor output shaft 54 and transmission 64 through shaft 72 to drive frac pump 16 and clutch 71 is disengaged to disconnect power transmission from primary electric motor 42 to frac pump 15. When in the normal-speed compound pump frac mode, both of the clutches 71, 73 are engaged so that power is transmitted from each of the primary electric motor's output shafts 52, 54, through transmissions 62, 64, and to both active frac pumps 15, 16.

Referring now to FIG. 4 and with background reference to FIG. 2 to show various components, different component states are shown for various modes and sub-modes of system 10. Within the chart, cells with a letter designation "A" represent active components and cells with a letter designation "I" represent inactive components. In the group of the top three rows representing the starting mode, it is shown that during all versions of starting modes, both slow-frac-APUs 103, 105 are inactive, primary electric motor 42 is inactive, and both frac pumps 15, 16 are inactive. During each of the single-APU starting modes, only one of the start-APUs 102, 104 is active and during the compound-APU staring mode, both of the start-APUs 102, 104 are active. In the group of the middle three rows representing the slow speed frac mode, it is shown that during all versions of the slow speed frac modes, both start-APUs 102, 104 are inactive and primary electric motor 42 is inactive. During each of the single-APU slow speed frac modes, a paired set of a slow-frac-APU 103, 105 and a cooperating frac pump 15, 16 are active. During the compound-APU slow speed frac mode, both slow-frac-APU 103, 105 and both frac pumps 15, 16 are active. In the group of the bottom three rows representing the normal speed frac mode, it is shown that during all versions of the normal speed frac modes, the primary electric motor 42 is active, both start-APUs 102, 104 are inactive, and both slow-frac-APU 103, 105 are inactive. During each of the single-pump normal speed frac modes, only one of the frac pumps 15, 16 is active and during the compound pump normal speed frac mode, both frac pumps 15, 16 are active.

Figure 5:
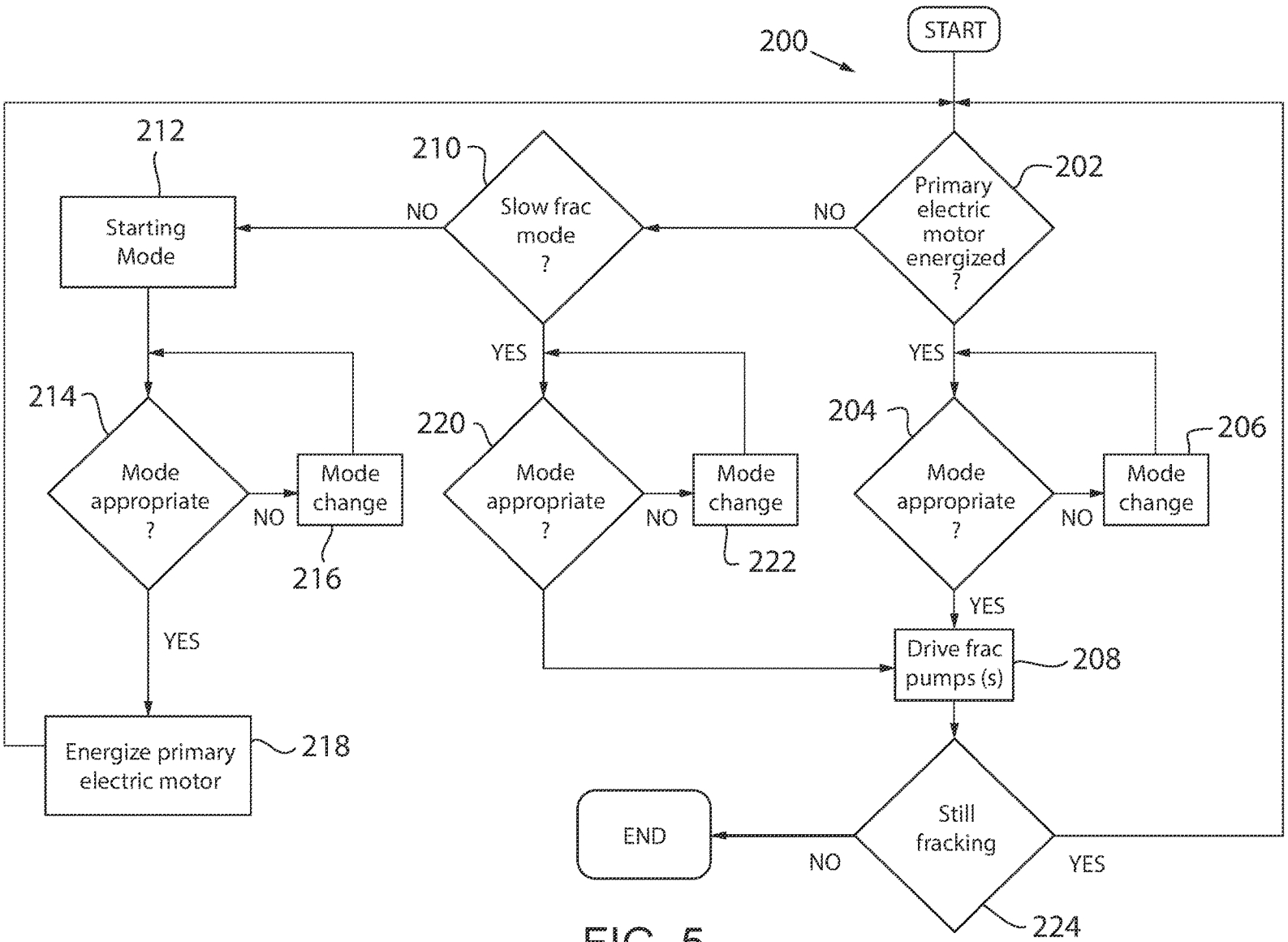
FIG. 5 is a flow chart illustrating a method of fracking according to the preferred embodiments.

A method 200 of fracking using the above-described systems of the preferred embodiments is set forth in FIG. 5, with background reference to FIGS. 1 and 2 for various components. Method 200 includes determining if a primary electric motor 42, such as that described previously, is energized at Block 202. If energized, at evaluation Block 204, the system evaluates whether the current normal speed frac mode is appropriate based on an underlying control methodology or predetermined fracking session parameters. This may include, for example, evaluating a timer that corresponds to different normal speed mode phases, and transitions between, according to the fracking procedure's control strategy or based on evaluated performance characteristics of the system, the well, or other aspects of the oilfield. At Block 206, if the system determines that a different normal speed frac mode should be implemented at that particular time, then the system commands a mode change which may include controlling, for example, one or both of the clutches 71, 73 and/or transmissions 62, 64. Normal speed frac mode changes include transitioning from one of the single-pump normal speed frac modes to a compound-pump normal speed frac mode, from a compound-pump normal speed frac mode to one of the single-pump normal speed frac modes, or from one of the single-pump normal speed frac modes to the other to switch between which of the frac pumps 15, 16 is active. At Block 208, one or both of the frac pumps 15, 16 is driven, based on the particular normal speed frac mode being implemented at that time.

Still referring to FIG. 5, If, on the other hand, the primary electric motor 42 is not energized, during method 200, the system determines whether it is already in or should engage a slow frac mode, in Block 210. If not, the system in initiates a starting mode in Block 212. In evaluation Block 214, the system evaluates whether the current starting mode is appropriate for the starting task. This may include comparing a rotational speed of the primary electric motor's main shaft to determine if it is being appropriately accelerated toward its fixed rated speed. If not, then at Block 216, the system commands a starting mode change. This may include changing from the activation of one of the start-APUs 102, 104 to the other one as a switch from one single-APU starting mode to the other or change to a compound-APU starting mode by activating both start-APUs 102, 104. Once the start-APU(s) 102, 104 sufficiently pre-rotates the primary electric motor's main shaft to bring it to its rated fixed or synchronous speed, a connection is made to the electrical power source DoL (Direct on Line) in Block 218. Once connected to the DoL, primary electric motor can drive the frac pump(s) of the system in Block 208.

Still referring to FIG. 5, when in slow frac mode, at Block 220, the system evaluates whether the current slow frac mode is appropriate based on an underlying control methodology or predetermined fracking session parameters. Like with the normal speed frac mode evaluation(s), this may include, for example, evaluating a timer that corresponds to different slow speed mode phases, and transitions between, according to the fracking procedure's control strategy or based on evaluated performance characteristics of the system, the well, or other aspects of the oilfield. At Block 222 if the system determines that a different slow speed frac mode should be implemented at that particular time, then the system commands a mode change which may include controlling, for example, one or both of the slow-frac-APUs 103, 105 and/or transmissions 62, 64. Slow speed frac mode changes include transitioning from one of the single-APU slow speed frac modes to a compound-APU slow speed frac mode, from a compound-APU slow speed frac mode to one of the single-APU slow speed frac modes, or from one of the single-APU slow speed frac modes to the other to switch between which of the slow-frac-APUs 103, 105 is active. Returning to Block 208, one or both frac pumps 15, 16 are driven, based on the particular slow speed frac mode being implemented at that time. The system determines if the fracking session is or should still be performed at Block 224 and, if so, continues as described above and, if not, the fracking session ends.

Although the best mode contemplated by the inventors of carrying out the present invention is disclosed above, practice of the above invention is not limited thereto. It will be manifest that various additions, modifications, and rearrangements of the features of the present invention may be made without deviating from the spirit and the scope of the underlying inventive concept.

We claim:

1. A compound electro-hydraulic fracturing (frac) pumping system of an electrically driven oilfield pumping system, the compound electro-hydraulic frac pumping system configured to pressurize a frac fluid for delivery into a well that extends into a subterranean geological formation and comprising:

a primary electric motor that defines a prime mover with multiple prime mover outputs that deliver power out of the primary electric motor, the multiple prime mover outputs including at least:

a first prime mover output; and a second prime mover output;

a transmission system that includes multiple transmissions, the multiple transmissions including at least:

a first transmission that receives power from the first prime mover output of the primary electric motor; and a second transmission that receives power from the second prime mover output of the primary electric motor;

a frac pump system that receives power from both the first and second transmissions to pressurize the frac fluid for delivery into the well; and an APU (auxiliary power unit) system that selectively delivers power into at least one of the first and second transmissions and defines multiple modes, including:

a single power delivery mode in which the APU system delivers power into one of the first and second transmissions; and a compound power delivery mode in which the APU system simultaneously delivers power into both the first and second transmission.

2. The system of claim 1, wherein the frac pump system includes multiple frac pumps, including at least:

a first frac pump that receives power from the first transmission; and a second frac pump that receives power from the second transmission.

3. The system of claim 2, wherein the primary electric motor is a constant speed AC (alternating current) motor that defines a fixed rated speed.

4. The system of claim 3, wherein the AC motor comprises:

a first output shaft that defines the first prime mover output; and a second output shaft that defines the second prime mover output.

5. The system of claim 4, wherein the first and second output shafts of the AC motor extend from opposite first and second ends of the AC motor so that the AC motor is arranged between and is generally longitudinally aligned with the first and second transmissions.

6. The system of claim 5, wherein the first and second output shafts of the AC motor are defined by opposite first and second shaft ends of an AC motor main shaft that extends through an entire length of the AC motor.

7. The system of claim 6, wherein:

the APU system selectively rotates at least one of the first and second shaft ends of the AC motor main shaft to approach a rated speed of the AC motor before energizing the AC motor to pressurize the frac fluid.

8. The system of claim 7, wherein the APU system includes an electro-hydraulic-start APU with a hydraulic motor as a hydraulic starting motor that delivers power through one of the first and second transmissions to rotate the AC motor main shaft to approach a rated speed of the AC motor before energizing the AC motor to pressurize the frac fluid.

9. The system of claim 7, wherein the APU system comprises an electro-hydraulic-slow-frac APU with a hydraulic motor as a hydraulic starting motor that delivers power through one of the first and second transmissions to deliver power to a corresponding one of the first and second frac pumps to pressurize the frac fluid.

10. The system of claim 9, wherein the electro-hydraulic-slow-frac APU includes an electric motor as a slow frac electric motor that delivers power to the corresponding one of the first and second frac pumps.

11. The system of claim 10, wherein at least one of the single and compound power delivery modes defines:

a slow speed frac mode in which the electro-hydraulic-slow-frac APU drives the corresponding one of the first and second frac pumps at an underdrive speed that is less than a normal speed defined when the corresponding one of the first and second frac pumps is driven at the fixed rated speed of the primary electric motor.

12. The system of claim 10, wherein:

the electro-hydraulic-slow-frac APU defines a first electro-hydraulic-slow-frac APU of a pair of electro-hydraulic-slow-frac APUs of the APU system; and the compound power delivery mode defines:

a compound-APU slow speed frac mode in which both of the electro-hydraulic-slow-frac APUs of the pair of electro-hydraulic-slow-frac APUs simultaneously deliver power to the first and second frac pumps to drive both of the first and second frac pumps at an underdrive speed that is less than a normal speed defined when the first and second frac pumps are driven at the fixed rated speed of the primary electric motor.

13. The system of claim 8, wherein the electro-hydraulic-start APU includes an electric motor as an APU electric starting motor that delivers power to the hydraulic starting motor.

14. The system of claim 13, wherein at least one of the single and compound power delivery modes defines:

a starting mode in which the electro-hydraulic-start APU delivers power that accelerates a rotation of the AC motor main shaft to a fixed rated speed of the primary electric motor before connecting a DoL (direct on line) electrical power source to the AC motor to energize the AC motor while the AC motor main shaft is rotating at the fixed rated speed.

15. The system of claim 13, wherein:

the electro-hydraulic-start APU defines a first electro-hydraulic-start APU of a pair of electro-hydraulic-start APUs of the APU system; and the compound power delivery mode defines:

a compound-APU starting mode in which both of the electro-hydraulic-start APUs of the pair of electro-hydraulic-start APUs simultaneously deliver power that accelerates the rotation of the AC motor main shaft to the fixed rated speed of the primary electric motor before connecting the DoL (direct on line) electrical power source to the AC motor to energize the AC motor while the AC motor main shaft is rotating at the fixed rated speed.

16. A compound electro-hydraulic fracturing (frac) pumping system of an electrically driven oilfield pumping system for pressurizing a frac fluid for delivery into a well that extends into a subterranean geological formation, the compound electro-hydraulic frac pumping systems comprising:

a primary electric motor that defines a prime mover;

a transmission system that includes:

a first transmission that receives power from the prime mover; and a second transmission that receives power from the prime mover;

a frac pump system that includes:

a first frac pump that receives power from the first transmission; and a second frac pump that receives power from the second transmission;

a control system that controls power delivery through the first and second transmissions to selectively deliver power to the respective first and second frac pump(s) to vary the flow of the frac fluid for delivery into the well; and an APU (auxiliary power unit) system that is controlled by the control system to selectively delivers power into at least one of the first and second transmissions and defines multiple modes, including:

a single power delivery mode in which the APU system delivers power into one of the first and second transmissions; and a compound power delivery mode in which the APU system simultaneously delivers power into both the first and second transmission.

* * * * *